US008749157B2

(12) United States Patent
Ludorf

(10) Patent No.: US 8,749,157 B2
(45) Date of Patent: Jun. 10, 2014

(54) METHOD AND APPARATUS FOR REGULATING THE BRIGHTNESS OF LIGHT-EMITTING DIODES

(75) Inventor: Werner Ludorf, Ruhpolding (DE)

(73) Assignee: Infineon Technologies Austria AG, Villach (AT)

( * ) Notice: Subject to any disclaimer, the term of this patent is extended or adjusted under 35 U.S.C. 154(b) by 714 days.

(21) Appl. No.: 12/910,407

(22) Filed: Oct. 22, 2010

(65) Prior Publication Data

US 2011/0095697 A1 Apr. 28, 2011

(30) Foreign Application Priority Data

Oct. 26, 2009 (DE) ..... 10 2009 050 651

(51) Int. Cl.
*H05B 37/02* (2006.01)

(52) U.S. Cl.
CPC ..... *H05B 37/02* (2013.01)
USPC ..... 315/224; 315/291; 315/297

(58) Field of Classification Search
CPC ..... H05B 37/02; H05B 41/36
USPC ..... 315/158, 209 R, 224, 279, 291, 297
See application file for complete search history.

(56) References Cited

U.S. PATENT DOCUMENTS

| | | | | |
|---|---|---|---|---|
| 7,288,902 | B1 | 10/2007 | Melanson | |
| 2003/0085749 | A1 * | 5/2003 | Xu et al. | 327/423 |
| 2008/0180036 | A1 | 7/2008 | Garrity et al. | |
| 2008/0278092 | A1 | 11/2008 | Lys et al. | |
| 2008/0316781 | A1 | 12/2008 | Liu | |
| 2009/0079358 | A1 * | 3/2009 | Shteynberg et al. | 315/291 |
| 2009/0121658 | A1 | 5/2009 | Steffen et al. | |
| 2009/0167203 | A1 | 7/2009 | Dahlman et al. | |
| 2009/0184666 | A1 | 7/2009 | Myers et al. | |
| 2010/0156319 | A1 * | 6/2010 | Melanson | 315/297 |

FOREIGN PATENT DOCUMENTS

| | | | |
|---|---|---|---|
| WO | 10 2007 002 809 | A1 | 7/2008 |
| WO | 10 2007 053 481 | A1 | 5/2009 |

* cited by examiner

*Primary Examiner* — Douglas W Owens
*Assistant Examiner* — Borna Alaeddini
(74) *Attorney, Agent, or Firm* — Slater & Matsil, L.L.P.

(57) ABSTRACT

Embodiments of the present invention relate to methods and circuits for brightness regulation for at least one light-emitting diode in the field of general lighting, more particularly, for incandescent lamp replacement by means of a supply voltage comprising a brightness level signal, wherein the brightness level signal contained in the supply voltage is decoded and converted into a modulation signal with a duty cycle corresponding to the brightness level signal for the purpose of driving a driver circuit for the at least one light-emitting diode.

19 Claims, 7 Drawing Sheets

METHOD AND APPARATUS FOR REGULATING THE BRIGHTNESS OF LIGHT-EMITTING DIODES

This application claims priority to German Patent Application 10 2009 050 651.9, which was filed Oct. 26, 2009, and is incorporated herein by reference.

FIELD OF THE INVENTION

The present invention generally relates to the field of regulating the brightness of light-emitting diodes.

BACKGROUND OF THE INVENTION

The scarcity of energy resources, particularly in the case of objects which are used in large numbers both in private households and beyond and are distinguished by a high energy conversion, has motivated ongoing development for increasing the energy efficiency. One particularly prominent example of this is a shift away from traditional incandescent lamps toward energy-saving lamps, the majority of which are still based on fluorescent tube technology.

This development is being pushed forward in the European Union, in particular, through corresponding legislative provisions which are gradually prohibiting the sale of traditional incandescent lamps in specific power classes.

Therefore, light-emitting diode technology, which is generally more efficient and is already being used increasingly in the motor vehicle sector, will gain additional importance in the area of application of general lighting as well. In particular, LED bulbs are replacing conventional incandescent lamps.

For these and further reasons there is a need for the present invention.

SUMMARY OF THE INVENTION

The invention is described hereinafter for illustration purposes inter alia with reference to brightness regulation for LED bulbs.

However, the invention is not restricted to such embodiments, but rather can find application in connection with regulating the brightness of any desired light-emitting diodes by means of a supply voltage comprising a brightness level signal. A central area of application is, however, regulating the brightness of at least one light-emitting diode in the area of general lighting, that is to say for example the area of lighting private, industrial, or public buildings and equipment—particularly for incandescent lamp replacement.

Apparatus and methods for regulating the brightness of light-emitting diodes are provided and are illustrated and/or described substantially in connection with at least one of the drawings, and are also set out comprehensively in the following description and patent claims.

Further objects, features and advantages of the present invention will become apparent from the following detailed description referring to the accompanying drawings showing exemplary embodiments—once again only for the purpose of illustrating the present invention.

BRIEF DESCRIPTION OF THE DRAWINGS

The drawings are enclosed in order to enable a deeper understanding of the invention. They constitute part of the disclosure of the invention. The drawings elucidate exemplary embodiments of the present invention, and serve, together with the description, to explain the principles of the invention. Further exemplary embodiments, and also many of the advantages of the present invention that are thereby striven for, will become readily apparent owing to the simpler comprehensibility thereof with reference to the following detailed description.

DETAILED DESCRIPTION OF ILLUSTRATIVE EMBODIMENTS

Figure 1:
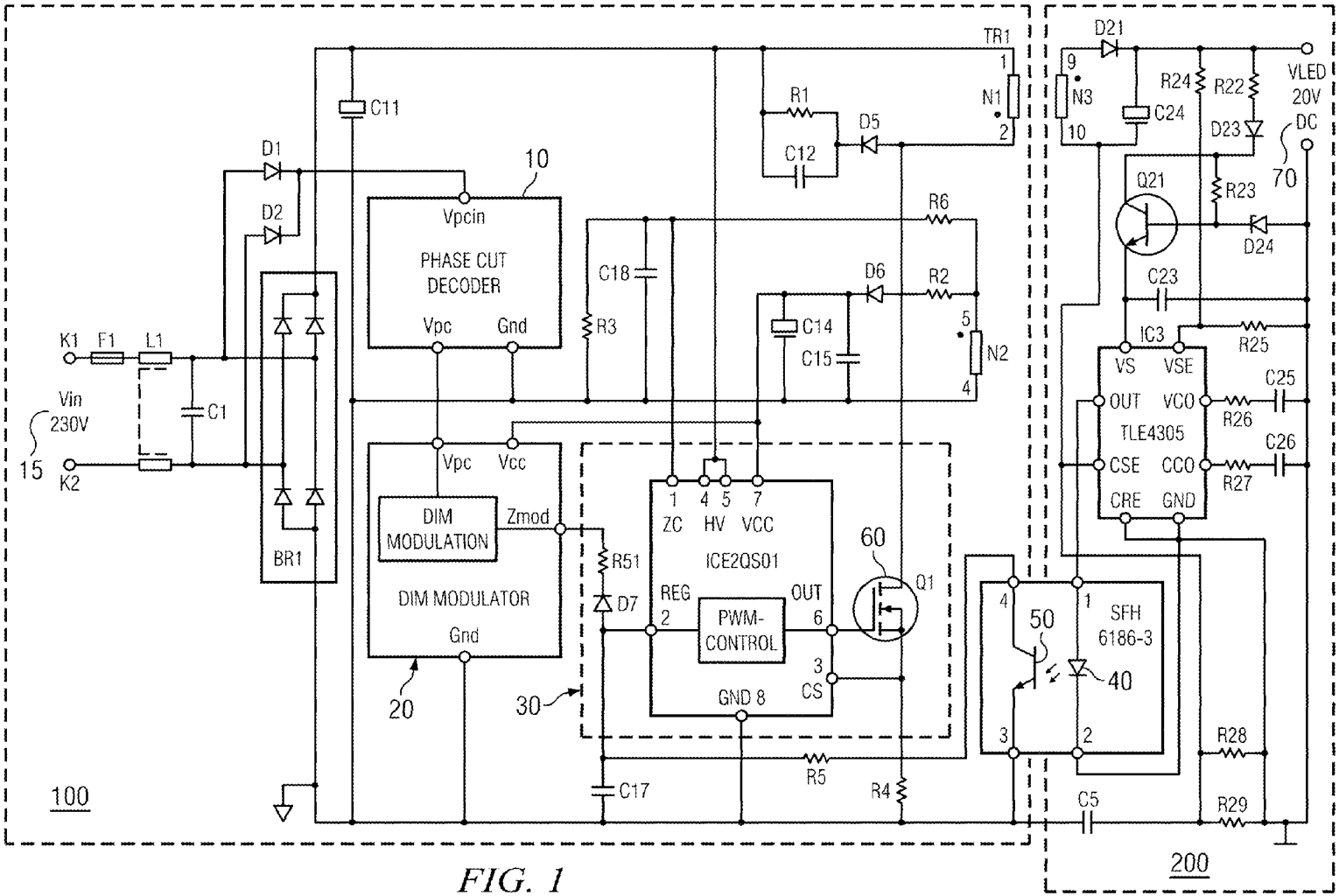
FIG. 1 shows an exemplary embodiment of a brightness-regulable isolated driver circuit for a light-emitting diode in a flyback converted topology using a discrete decoding circuit for a phase-gated or phase-chopped supply voltage ("phase cut decoder") wherein operating parameters for the light-emitting diode are detectable and regulable on the secondary side of the flyback converter topology.

The following detailed description refers to the accompanying drawings, which form part of the disclosure of the invention and represent, for illustration purposes, specific exemplary embodiments by means of which the invention can be implemented in practice. Other exemplary embodiments can be used, and structural and/or other modifications can be made without departing from the scope of protection of the present invention. Therefore, the following detailed description should not be interpreted in a restrictive manner. Rather, the scope of protection of the present invention is defined only by the accompanying patent claims.

Reference is made below to the development toward more and more efficient lighting technology as mentioned in the introduction. Particularly, in the area of general lighting, further energy savings are possible as evinced by the fact that existing lighting installations often contain brightness regulators (dimmers), by means of which the brightness of the bulb can be adapted to the present lighting conditions.

In this case the reduction of the average current through the bulb, said reduction generally being necessary for this purpose, is typically effected by means of brightness level signals contained in the specifically modified profile of the supply voltage for the bulb.

Many of the existing brightness regulators are realized in the form of so-called phase dimmers. The latter control the brightness by virtue of the fact that they modify the profile of the supply voltage for the bulb by causing the voltage to vanish between the zero crossings and an adjustable phase angle of a sinusoidal AC voltage. Depending on whether the part adjoining the first zero crossing of a half-cycle of the sinusoidal AC voltage or a part before the second zero crossing of a half-cycle vanishes, the designation employed in this connection is a phase-gated or, respectively, a phase-chopped voltage.

Furthermore, more recent types of lighting control with extended functionality are also being used, which makes use of so-called "power line communication", for example. The latter is based on the fact that voltage signals for controlling a lighting device are superposed on a sinusoidal power supply voltage in accordance with a defined communication protocol. Over and above pure brightness regulation, these superposed voltage signals can be used to control further-reaching functions of lighting devices.

The particular use of the above-mentioned known techniques for brightness regulation involves specific challenges in the area of application of general lighting with bulbs and lighting devices based on light-emitting diodes.

One of these challenges is to reduce the current (which determines the brightness) of the light-emitting diodes without incurring losses with regard to color temperature and luminous efficiency of the light-emitting diode, and also the energy efficiency of a driver circuit for the light-emitting diodes.

A further challenge consists in the ability to store energy, which is not present in light-emitting diodes in contrast to incandescent lamps. As a result, even periodic gaps in the temporal profile of the light-emitting diode current (hereinafter "LED current") whose period duration corresponds to a frequency of up to 100 Hz can still be perceived as a flicker.

The specifics mentioned above, in connection with light-emitting diodes, thus make stringent requirements of brightness regulation in the form of a permanently defined current profile through the light-emitting diodes.

Accordingly, bulbs based on light-emitting diodes that have screw-type lampholders (for example E27/E14/ . . . ) as incandescent lamp replacements have not been regulable in terms of their brightness, or with satisfactory light quality and acceptable efficiency of the driver circuit. Relative to the latter case, the output voltage of the phase dimmer in specific previous LED bulbs is utilized simply to bring about a reduction of the DC current through the light-emitting diode.

In other known LED bulbs, the output voltage of the phase dimmer brings about a pulse width modulation of the current through the light-emitting diode by means of a low-frequency pulse width modulation (PWM) of an additional switch at the output stage of the driver circuit. In both cases, constant high-frequency clocking of the driver circuit for the light-emitting diodes is effected for effective energy transport from the driver circuit to the light-emitting diodes.

In terms of regulating the brightness by reducing the DC current, the current through the light-emitting diodes, as the brightness is increasingly limited, lies far outside the optimum operating range of the light-emitting diodes. This results in the disadvantage, inter alia, of a lack of color constancy of the light of the light-emitting diode on account of a change in wavelength in the emitted light spectrum.

Furthermore, the efficiency of a driver circuit limited to 10%, for example, of the maximum brightness regulator setting falls in this case to typically only 30% of the efficiency in the state of non-limited brightness (also called non-dimmed state). Moreover, the system luminous efficiency also decreases significantly as a result of the previous mechanisms for limiting the brightness.

In the case of brightness regulation by pulse width modulation by means of an additional output stage of the driver circuit, the above-mentioned impairment of the light quality does not actually occur. Other than the increased circuitry outlay owing to the additional output stage, the permanently constant clocking of the driver circuit, in the case of low brightness regulator settings and also the losses in the additional output stage, bring about a further reduced efficiency of the driver circuit.

In order to eliminate the disadvantages described in embodiments of the present invention, a brightness level signal DL contained in a supply voltage for the at least one light-emitting diode, for driving a driver circuit for the at least one light-emitting diode, is decoded. The decoded brightness level signal DL can be converted, by means of a defined method, into a low frequency modulation signal M2 with a duty cycle D2 corresponding to the brightness level signal DL.

In this case, the modulation signal M2 can have ON phases and OFF phases for activating and, respectively, deactivating the driver circuit, the temporal durations of which are in the ratio of the duty cycle D2. In particular, the modulation signal M2 can fully switch off the driver circuit for the at least one light-emitting diode in the OFF phases of the modulation signal M2.

The above-mentioned pulse-width-modulated clocking by a high-frequency modulation signal M1 of the power switch of the LED driver circuit (the power switch being crucial for the energy flow) is accordingly superposed by the further modulation signal M2 which is, rather, of low frequency by comparison therewith. In the OFF phases of the modulation signal M2, the power switch (such as a power transistor, for example) of the driver circuit for the at least one light-emitting diode is therefore not driven.

By means of the superposition of the modulation signals M2 and M1 at a suitable location of the topology of the driver circuit (such as, for example, at the control input of the controller for generating the high-frequency modulation signal M1) the desired modulation of a constant current through the at least one light-emitting diode (such as, for example, pulse width modulation (PWM), pulse density modulation (PDM), or else further types of modulation) can be generated at the output of the driver circuit in a simple manner. This is advantageous since a customary topology of the driver circuit can be set up without having to add components in the output stage circuit of the driver circuit, said output stage circuit being critical with regard to the circuit efficiency.

In contrast to earlier brightness regulators, the output signal of the driver circuit is still switched between full signal levels during the ON phase of the modulation signal M2 modulated by the high-frequency modulation signal M1. In other words, the limiting or dimming of the brightness level is not achieved by means of decreasing signal levels of the output signal of the driver circuit. Rather, the at least one light-emitting diode remains in a desired operating range of current and voltage with good color constancy and defined luminous efficiency by virtue of the full output signal levels of the driver circuit during the ON phase of the modulation signal M2. Moreover, an operating state of the driver circuit for the at least one light-emitting diode with maximum efficiency arises during the ON phase of the modulation signal M2.

In the example of a driver circuit that is embedded into a flyback converter topology and that is driven by the superposition of a high-frequency modulation signal M1 by a "low-frequency" modulation signal M2, in the case of a lower brightness regulator setting (also called "dim setting" of 10%) with a corresponding brightness level signal DL (or a resulting duty cycle D2 of the modulation signal M2) the efficiency of the driver circuit is generally still above 70% relative to the efficiency of the driver circuit in the undimmed case, that is to say a brightness regulator setting of 100%.

With the same lower brightness regulator setting of 10%, in the case of the driving of the driver circuit only by the high-frequency modulation signal M1 (that is to say permanent driving and clocking of the driver circuit, but with lower signal levels compared with those during the ON phase of the modulation signal M2) the efficiency of the driver circuit by contrast only attains typical values of 30%.

Figure 4:
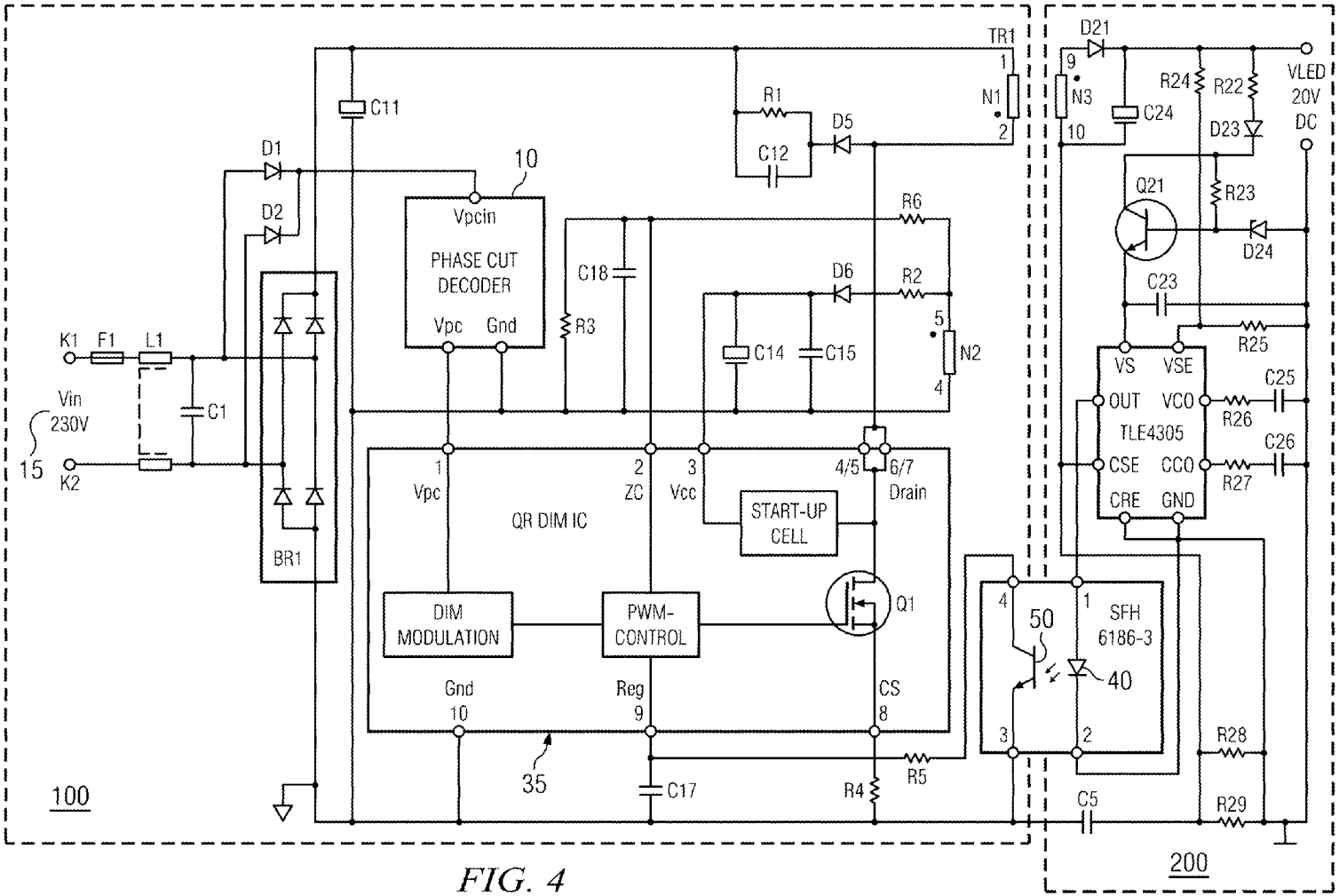
FIG. 4 shows an exemplary embodiment of a brightness-regulable isolated driver circuit for a light-emitting diode in a flyback converter topology using a discrete decoding circuit for a phase-gated or phase-chopped supply voltage ("phase cut decoder") and a driver circuit with integrated modulator circuit ("DIM modulation"), wherein operating parameters for the light-emitting diode are detectable and regulable on the secondary side of the flyback converter topology.
Figure 5:
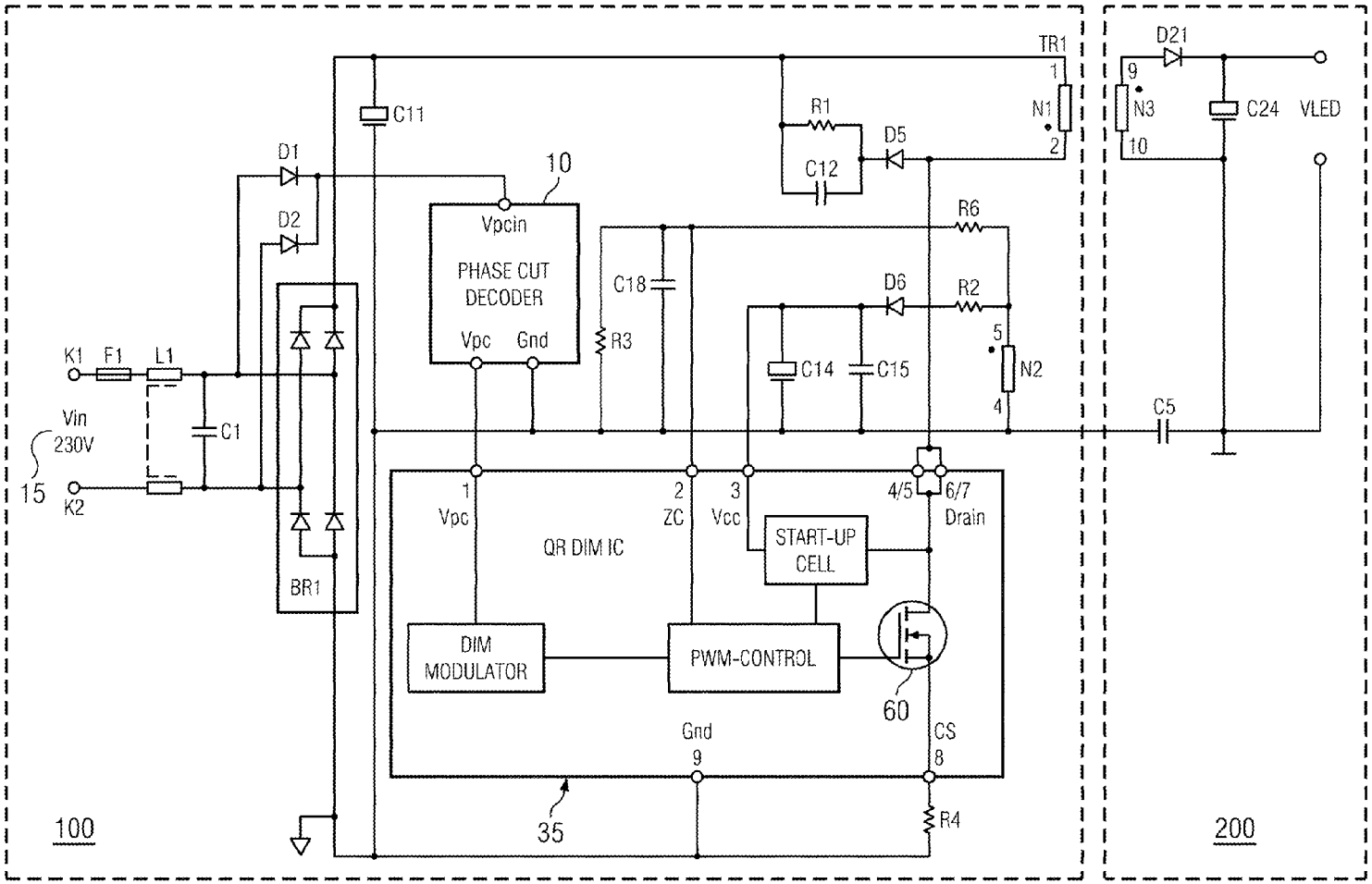
FIG. 5 shows an exemplary embodiment of a brightness-regulable isolated driver circuit for a light-emitting diode in a flyback converter topology using a discrete decoding circuit for a phase-gated or phase-chopped supply voltage ("phase cut decoder") and a driver circuit with integrated modulator circuit ("DIM modulator"), wherein operating parameters for the light-emitting diode are derivable and regulable on the primary side of the flyback converter topology.

As shown in the exemplary embodiments in FIGS. 1, 4 and 5, the driver circuit in the typical field of application of general lighting can be driven by an AC/DC converter in order to convert an AC voltage (such as, for example, a general power supply system AC voltage of 230 V regulated by a phase dimmer) as the supply voltage into a modulated constant current for the at least one light-emitting diode. By way of illustration, as seen by the exemplary embodiments in FIGS. 4 and 5, it is possible to use a flyback converter topology as an AC/DC converter in particular in a quasi-resonant (QR) operating mode.

The comparison between the exemplary embodiments in FIGS. 4 and 5 shows here that the determination (necessary for regulating the brightness) of actual operating parameters of the light-emitting diode 40 can be effected in various ways.

Thus on the one hand, as in the exemplary embodiment according to FIG. 4, the current through the light-emitting diode 40 as such an actual operating parameter can be detected on the secondary side 200 (indicated by the dotted border) of the flyback converter in a directly electrically isolated manner by means of the optocoupler 50.

On the other hand, as in the exemplary embodiment according to FIG. 5, actual operating parameters of the light-emitting diode 40 can be derived from the ratios of the on and off times of the power switch 60 on the primary side 100 (indicated by the dashed border) of the flyback converter.

The latter option only functions well in practice, however, as long as the output levels of the power switch 60 have the largest possible, in the best case maximum, signal levels for driving the light-emitting diode 40. In some of the previous brightness regulating solutions, however, limiting the brightness level of the light emitted by the light-emitting diode 40 by means of a phase dimmer, on account of simple driving of the driver circuit only by the high-frequency modulation signal M1, is accompanied by decreasing signal levels of the output signal of the power switch 60 of the driver circuit.

Therefore, in such conventional solutions, this makes it more difficult to derive the ratios of the on and off times of the power switch 60 on the basis of the thus decreased signal levels of the output signal of the power switch 60 and, hence, actual operating parameters of the light-emitting diode 40 such as the DC current through the light-emitting diode 40 on the primary side 100 of a converter.

In embodiments of the present invention, however, the output signal of the power switch 60 of the driver circuit, in contrast to the previous brightness regulating solutions mentioned, is additionally modulated by the modulation signal M2 and, as a result, can still be switched between full signal levels during the ON phase of the modulation signal M2 modulated by the high-frequency modulation signal M1.

Therefore, the embodiments of the present invention permit a facilitated determination of the ratios of the on and off times of the power switch 60 on the basis of the full signal levels of the output signal of the power switch 60 during the ON phase of the modulation signal M2, and hence a facilitated and more accurate derivation of actual operating parameters of the light-emitting diode on the primary side 100 of an AC/DC converter.

Such brightness regulation based on the primary side of an AC/DC converter (this is also referred to as primary regulation) thus affords the advantages of saving costs and saving space in particular, as a result of the omission of the components for secondary-side detection of the actual operating parameters of a light-emitting diode.

In this respect, embodiments of the present invention for the realization of cost-efficient brightness regulation on the primary side, enable advantages with regard to precise regulation of the LED current by comparison with previous methods based, for example, on the reduction of a (DC) LED current, the detection of which is made more difficult on the primary side as explained above, or on an additional power switch clocked in a pulse-width-modulated manner in the output circuit of the driver circuit for the light-emitting diode.

Referring to the exemplary embodiment according to FIG. 1, in accordance with the brightness level signal (also called dim signal, or dim level DL) contained in the temporal profile of the supply voltage, particularly with the use of phase dimmers (phase cut dimmer) or upon superposition by "power line communication" signals, a decoding of the supply voltage can be effected in the phase cut decoder 10.

The phase cut decoder 10, as a decoding circuit, decodes the brightness level signal DL in the phase-gated or phase-chopped supply voltage 15 Vin(DL,t) (here on the basis of a power supply system AC voltage of 230 V) and generates a control voltage Vpcin(DL,t) corresponding to the brightness level signal DL and/or a divided-down control voltage Vpc (DL,t) proportional thereto. By means of one of these control voltages, the phase cut decoder 10 can directly drive a dim modulator 20 as modulator circuit for generating the modulation signal M2.

Furthermore, FIG. 1 shows the provision of the defined "low-frequency" modulation signal M2 with the duty cycle D2 corresponding to the brightness level signal DL, in the dim modulator 20. Said dim modulator 20 can put the driver circuit 30 for the light-emitting diode 40 and the light-emitting diodes to be connected between the terminals 70, during said ON phases and OFF phases of the modulation signal M2, into correspondingly defined fully switched-on or fully switched-off operating states (ON, OFF).

In a further exemplary embodiment, the dim modulator 20 can put the driver circuit 30, during the ON phases and REDUCED phases of the modulation signal M2, into correspondingly defined fully switched-on or reduced switched-on operating states (ON, REDUCED).

The latter case with the reduced switched-on operating state (REDUCED) is appropriate in order to enable a continuous current consumption of the light-emitting diode for brightness-regulated operation particularly in the case of driving by a phase dimmer. In the reduced switched-on operating state, for example, it is possible for the light-emitting diode to be fed current only in an amount such that the light-emitting diode emits a luminous flux that is negligible in relation to the luminous flux that arises during the fully switched-on operating state (ON).

The reduced switched-on operating state can be further dimensioned, for example, such that the driver circuit is supplied with a current that suffices to avoid undesired states of the driver circuit, and of the circuits driven thereby, such as acoustic emissions in particular.

In one exemplary embodiment, during the ON phase of the modulation signal M2, with OFF phases, wherein the durations of the ON phases and OFF phases are in the ratio according to the duty cycle D2 where D2min<D2≤1 and D2min>0, the high-frequency modulation signal M1 continues as in the undimmed state. In particular, the high-frequency modulation signal M1 is pulse-width-modulated with a duty cycle D1 in the range of 0<D1<1.

During the OFF phase of the modulation signal M2 with a duty cycle D2 where D2min<D2≤1 the driver circuit for the light-emitting diode is deactivated. As a result, the high-frequency modulation signal M1 is suppressed in accordance with D1=0 in this phase.

In a further exemplary embodiment, during the ON phase of a modulation signal M2 with REDUCED phases, wherein the durations of the ON phases and REDUCED phases are in the ratio according to the duty cycle D2 where D2min<D2≤1 and D2min>0, the high-frequency modulation signal M1 continues as in the undimmed state. In particular, the high-frequency modulation signal M1 is pulse-width-modulated with a duty cycle D1 in the range of 0<D1<1.

In this exemplary embodiment, the high-frequency modulation signal M1 continues during the REDUCED phases of the modulation signal M2 with the duty cycle D2 where D2min<D2≤1. In particular, the high-frequency modulation signal M1 is pulse-width-modulated with a duty cycle D1 in the range of 0<D1<D1red wherein the duty cycle D1red is chosen such that the supply of a control circuit (also called controller circuit) for the light-emitting diode continues to a sufficient extent.

Moreover, the modulator circuit can be embodied such that, for control voltages Vpc less than a minimum control voltage Vpcmin for the duty cycle D2, it holds true that D2(0≤Vpc<Vpcmin)=D2min where PLED(D2min)=PLEDmin. That is to say, at a minimum control voltage Vpcmin, the minimum duty cycle D2min and the minimum brightness of the light-emitting diode arise on account of the minimally consumed LED power PLEDmin with good color constancy.

Furthermore, the modulator circuit can generate, for the maximum control voltage Vpcmax, a modulation signal M2 with a maximum duty cycle D2(Vpcmax)=D2max where PLED(D2max)=PLEDmax. That is to say, at a maximum control voltage Vpcmax, the maximum duty cycle D2max and the maximum brightness of the light-emitting diode arise on account of the maximally consumed LED power PLEDmin with good color constancy.

In embodiments, the modulation signal M2, in the case of its pulse width modulation, has a sufficiently high repetition frequency (>100 Hz) or, in the case of other types of modulation of the modulation signal M2, correspondingly temporally short maximum OFF phases and/or REDUCED phases (<10 ms) resulting in no flicker phenomena of the light from the light-emitting diode becoming visible.

As previously indicated, FIG. 1 shows an exemplary embodiment of a brightness-regulable driver circuit for light-emitting diodes in a flyback converter topology as an AC/DC converter. In this case, the flyback converter can be operated in a quasi-resonant (QR) mode and in a hard-switching fashion.

The exemplary embodiment according to FIG. 1 shows, like the exemplary embodiment according to FIG. 4 mentioned above, secondary regulation of the operating parameters of the light-emitting diode, such as the LED current in particular. The exemplary embodiment according to FIG. 1 can be used for LED bulb applications as incandescent lamp replacement with a lighting control function by means of commercial phase dimmers.

In the case where a modulation signal M2 with OFF phases is used in the exemplary embodiment according to FIG. 1, the output impedance of the dim modulator 20 at the port "Zmod" is large relative to the input impedance at the port "REG" of the driver circuit 30 during the ON phases of the modulation signal M2. Consequently, the duty cycle D1 of the high-frequency modulation signal M1 is regulated by a pulse width modulation control circuit within the driver circuit 30 in the ON phase of the modulation signal M2 as in the undimmed state.

The port "REG" of the driver circuit 30 in the exemplary embodiment according to FIG. 1 is connected to the output of the optocoupler 50 via the ohmic resistor R5. Therefore, the port "REG" serves primarily for the feedback of the operating parameters of the light-emitting diode that are detected on the secondary side by means of the optocoupler 50 for the setting of a corresponding duty cycle D1 of the high-frequency modulation signal M1 in order to operate the light-emitting diode at a specific operating point with predetermined luminous efficiency and color constancy.

Furthermore, the port "REG" of the driver circuit 30 is also connected to the output port "Zmod" of the dim modulator 20 in order to be able to superpose the low-frequency modulation signal M2 on the high-frequency modulation signal M1 in a simple manner, that is to say, without a further switch in the output stage of the driver circuit 30.

As a result, the port "REG" of the driver circuit 30 is used both for the regulation of the duty cycle of the high-frequency modulation signal M1 by the output of the optocoupler 50 and for the processing of the brightness regulation signal in the form of the superposed low-frequency modulation signal M2. Thus, in the OFF phase of the modulation signal M2, for example, the port "REG" can be actively pulled to ground in order to thereby constrain a duty cycle D1=0 of the high-frequency modulation signal M1 and, in this respect, to prevent the power switch 60 of the driver stage 30 from being driven during the OFF phase of the modulation signal M2.

In the case where a modulation signal M2 with REDUCED phases is used in the exemplary embodiment according to FIG. 1, the port "REG" is set during the REDUCED phases of the modulation signal M2, to a voltage value VREG>0 corresponding to the reduced switched-on operating state of the driver circuit 30, which voltage value results in a reduced power consumption in this phase.

In embodiments, the periods of the high-frequency modulation signal M1 are not interrupted by the change between the phases of the modulation signal M2, thus, resulting in a quantization to full periods of the high-frequency modulation signal M1.

In the exemplary embodiment according to FIG. 1, the supply voltage for the dim modulator 20 is obtained from an auxiliary winding of the flyback converter.

Figure 2:
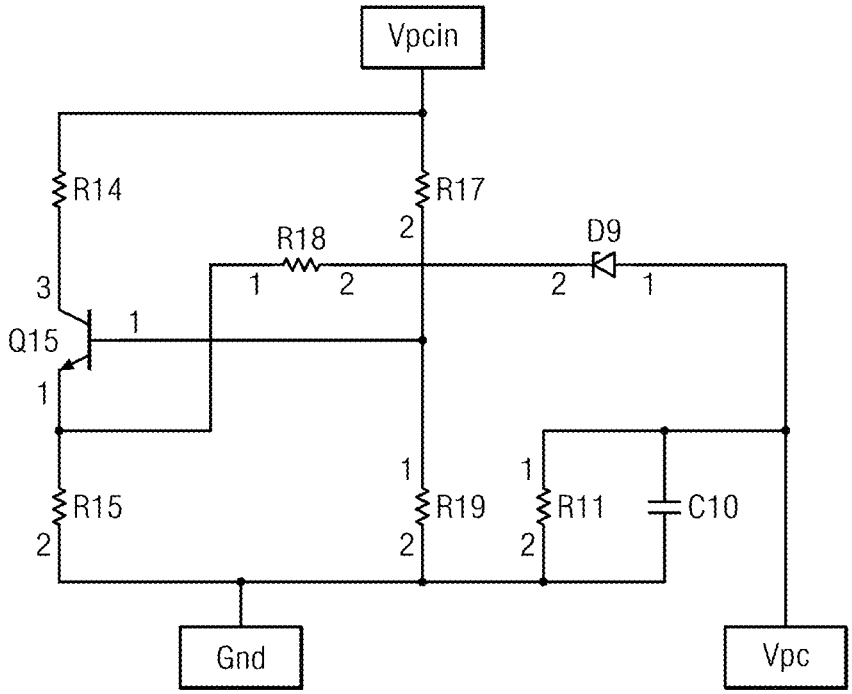
FIG. 2 shows an exemplary embodiment of a discrete decoding circuit for a phase-gated or phase-chopped supply voltage ("phase cut decoder")

FIG. 2 shows an exemplary embodiment of a discrete decoding circuit (designated there by "phase cut decoder") for a phase-gated or phase-chopped supply voltage Vin(t). The discrete decoding circuit according to FIG. 2 divides a control voltage Vpcin(DL,t), dependent on the brightness level signal DL in the supply voltage Vin(t), down to a control voltage Vpc(DL,t) by means of the voltage divider R17, R19 for processing in the dim modulator 20 according to FIG. 1.

Furthermore, the time-dependent control voltage Vpcin (DL,t) can be reduced by a virtually constant voltage value Vconst. As shown in the exemplary embodiment in FIG. 2, the reduction can be effected by means of the zener diode D9 or else by means of a diode in a forward direction.

The voltage reduced by Vconst, or else the non-reduced voltage, can be integrated with respect to time such that with the brightness level signal DL corresponding to the root-mean square value of the output voltage of the phase dimmer, an integrated control voltage results as $$\overline{V}pc(DL, t) = \frac{1}{\tau_0}\int^{\tau}[Vpc(DL, t)[-Vconst]].$$

In one exemplary embodiment, the integrated time constant τ can be chosen such that, given a constant brightness level signal DL at the output port "Vpc" of the decoding circuit according to FIG. 2, a temporally constant average voltage $\overline{V}$pc(DL) results as the integrated control voltage.

In a further exemplary embodiment, the integration time constant τ for the output port "Vpc" of a decoding circuit can be chosen such that a temporally variable integrated control voltage $\overline{V}$pc(DL, t) over the phase angle of the supply voltage Vin(t) arises and the current consumption of the driver circuit can be set with regard to a maximum stability during operation with phase dimmers.

In yet another exemplary embodiment in accordance with FIG. 1, the integration time constant τ for the output port "Vpc" of a decoding circuit can be chosen to be less than half the period duration of the supply voltage Vin(t), such that a temporal variation of the integrated control voltage $\overline{V}$pc(DL, t) over the phase angle of the supply voltage Vin(t) occurs. This results in a variation of the duty cycle D2 of the modulation signal M2, wherein the temporally variable integrated control voltage $\overline{V}$pc(DL, t) can be chosen such that the power factor PF of the resulting current consumed by the driver circuit can be increased to a power factor PF>0.7 with a sufficiently small capacitance value C11 at the circuit input.

This example shows that the temporal variability of the integrated control voltage $\overline{V}$pc(DL, t) for the modulator circuit can be utilized to adapt the temporal profile and the shape, that is to say, the harmonic content of the current consumed by the driver circuit to the temporal profile and the shape of the voltage fed to the driver circuit. Accordingly, the power factor of the current consumed by the driver circuit can be increased in order to meet certain standardization requirements. For example, by increasing the power factor it is possible to prevent the deformation of the sinusoidal shape of the customary power supply system AC voltage in private households or, to a greater extent, in office or industrial buildings as a result of numerous LED bulbs having an excessively small power factor.

In a further exemplary embodiment, the duty cycle D1 of the high-frequency modulation signal M1 is increased at the beginning of the ON phase of the modulation signal M2 from a predetermined first value over a plurality of periods of the modulation signal M1 continuously to a second value, which results from the feedback signal detected on the secondary side for the regulation of the LED current. Before the end of the ON phase of the modulation signal M2 is reached, the duty cycle D1 is decreased again over a plurality of periods of the high-frequency modulation signal M1 continuously to the first value. This enables acoustic emissions of the driver circuit to be avoided.

In a further exemplary embodiment in accordance with that in FIG. 2, the divided-down control voltage $$Vpcin(DL, t)\cdot\frac{R19}{R17+R19}$$

can be fed without further integration directly to the modulator circuit.

Figure 3:
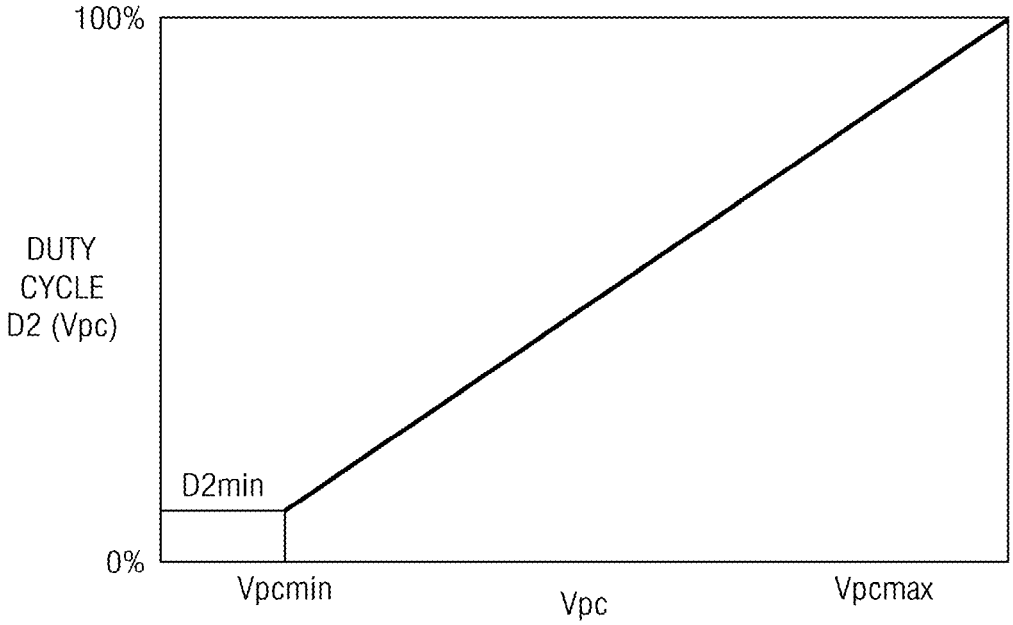
FIG. 3 shows a typical profile of the duty cycle D2 of a modulation signal M2 at the output of a modulator circuit as a function of a temporally constant integrated control voltage $\overline{V}$pc(DL) as output voltage of the decoding circuit in accordance with one exemplary embodiment.

FIG. 3 shows a typical profile of the duty cycle D2 of a modulation signal M2 at the output of a modulator circuit as a function of a temporally constant integrated control voltage $\overline{V}$pc(DL) as output voltage of the decoding circuit in accordance with one exemplary embodiment. In this exemplary embodiment, the dependence of the duty cycle D2(Vpc) of the modulation signal M2 on the voltage at the output port "Vpc" of the decoding circuit proceeding from a minimum value D2min has a monotonically rising linear profile with a maximum value of D2max≤100%. With regard to the discrete decoding circuit according to FIG. 2, the impedance converter and the nonlinear component (in that case the zener diode D9) can be dimensioned for a desired minimum value D2min.

For an integrated solution, the decoding circuit can also be embodied such that a sufficiently divided-down control voltage Vpc(DL,t) proportional to the control voltage Vpcin(DL, t) is transferred to the modulator circuit for generating the duty cycle D2(Vpc(DL)).

Figure 6:
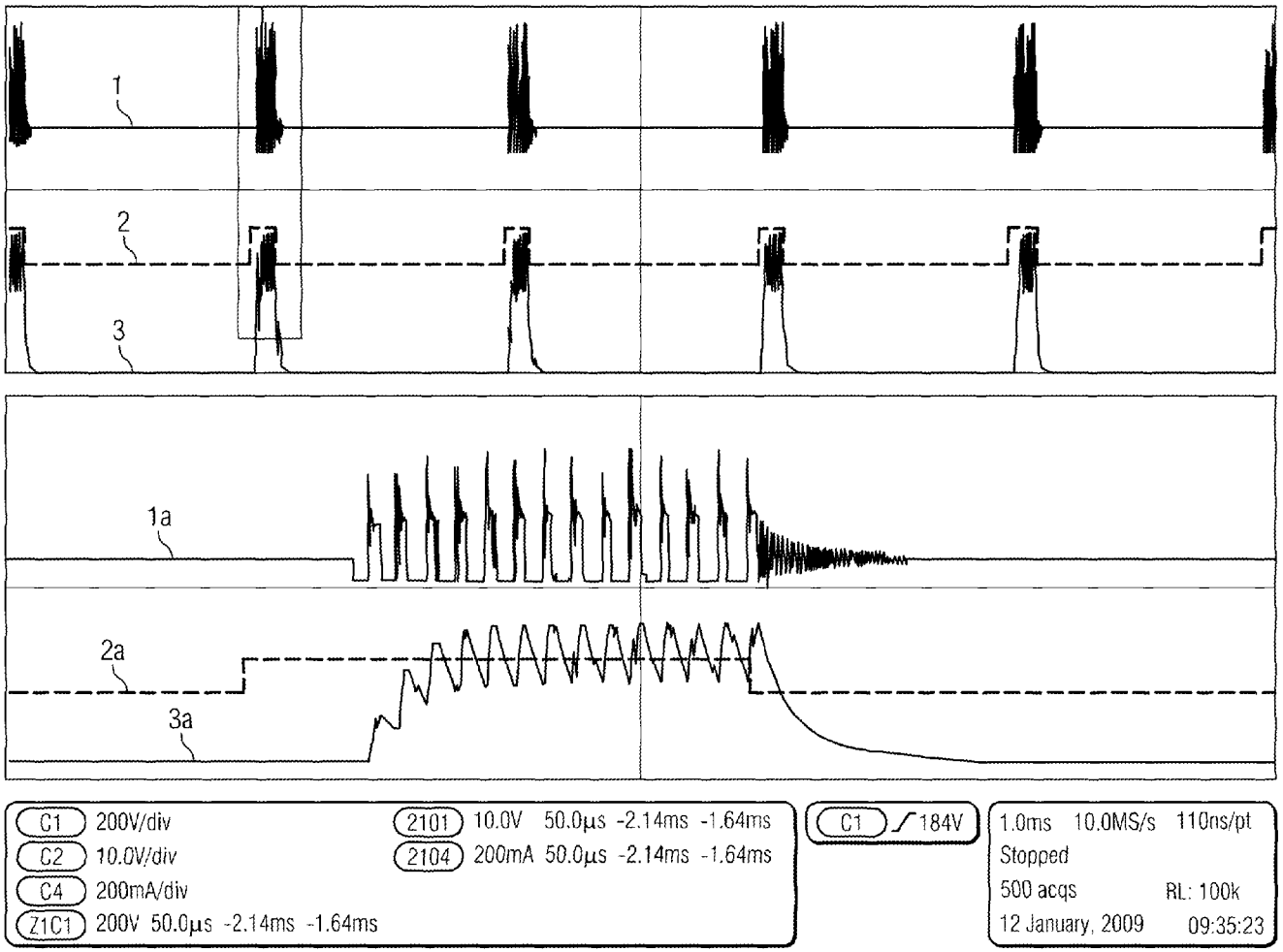
FIG. 6 shows an exemplary embodiment of time profiles of operating parameters of a light-emitting diode on account of the superposition of a low-frequency modulation signal M2 for driving a driver circuit for the light-emitting diode with a frequency f(M2)=500 Hz and a high-frequency pulse-width-modulated modulation signal M1 for efficient energy transfer from the driver circuit to the light-emitting diode.

FIG. 6 shows the time profiles of operating parameters of a light-emitting diode. Time profiles of this type can arise as seen in the exemplary embodiment illustrated on account of the superposition of a high-frequency pulse-width-modulated modulation signal M1 by a low-frequency modulation signal M2 having a frequency f(M2)=500 Hz. In the upper region of FIG. 6, the reference symbol 1 denotes the temporal profile of the drain/source voltage at the power transistor 60 over five periods of the low-frequency modulation signal M2, the temporal profile of which is designated by the reference symbol 2. The temporal profile of the LED current which results for this exemplary embodiment is finally designated by the reference symbol 3.

In the lower region of FIG. 6, for clarification of the resulting superposition signal made from the high-frequency modulation signal M1 by means of the modulation signal M2, the region enclosed by a border in the upper region of FIG. 6 is illustrated in a temporally stretched manner and highlights in particular an ON phase of the modulation signal M2. In the lower region of FIG. 6, the reference symbol 1*a* denotes the stretched temporal profile of the drain/source voltage at the power transistor 60, the reference symbol 2*a* denotes the stretched temporal profile of the modulation signal M2 and the reference symbol 3*a* denotes the stretched temporal profile of the LED current.

Figure 7:
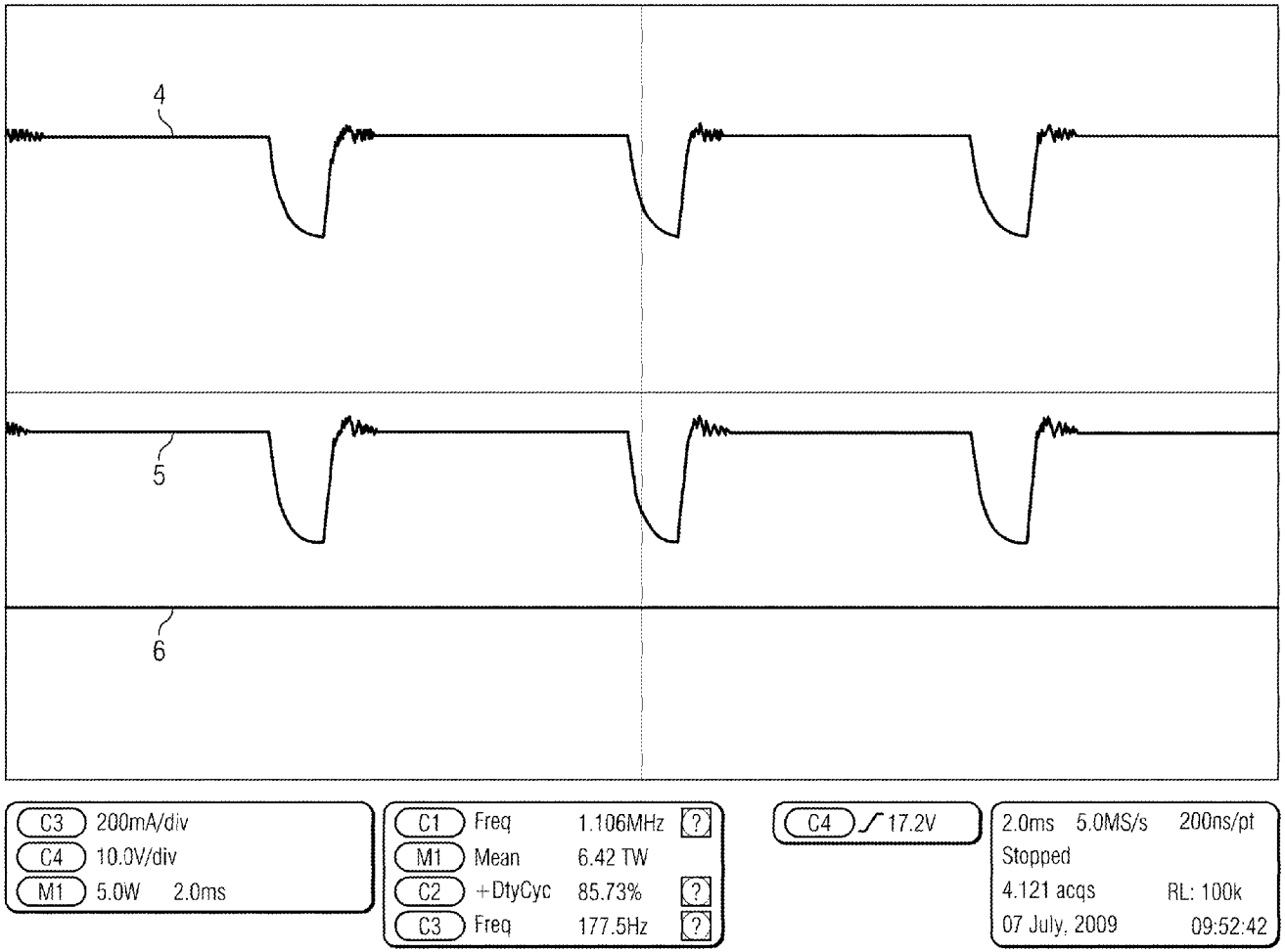
FIG. 7 shows an exemplary embodiment of time profiles of operating parameters of a light-emitting diode on account of a low-frequency modulation signal M2 for driving a driver circuit for the light-emitting diode with a frequency f(M2) ~200 Hz and a duty cycle D2=85% of the modulation signal M2 at an upper brightness setting of a phase dimmer.

FIG. 7 shows an exemplary embodiment of time profiles of operating parameters of a light-emitting diode which occur as a result of a low-frequency modulation signal M2 having a frequency f(M2)~200 Hz and a duty cycle D2=85% of the modulation signal M2 in the case of an upper brightness setting on a phase dimmer.

Figure 8:
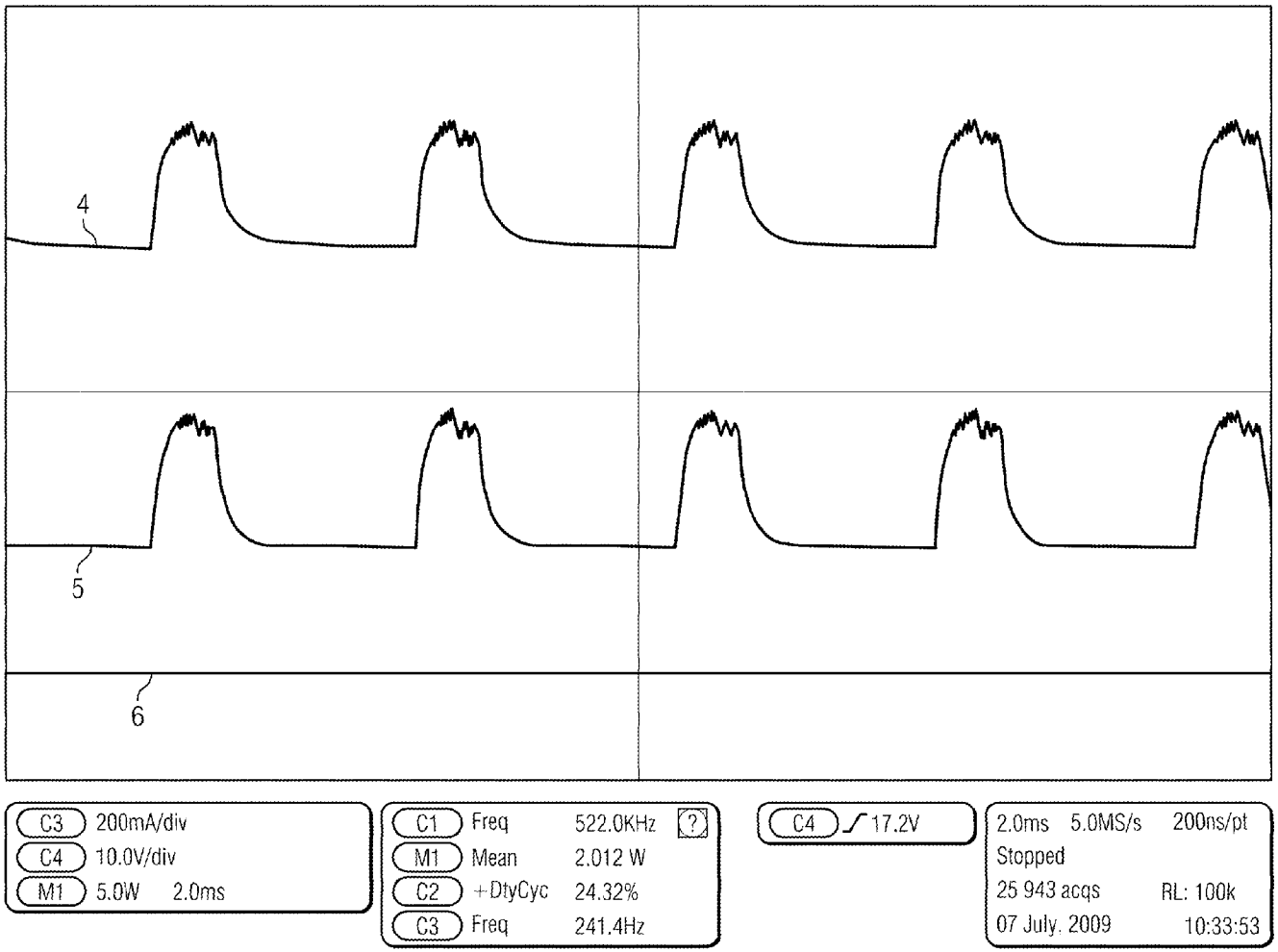
FIG. 8 shows an exemplary embodiment of time profiles of operating parameters of a light-emitting diode on account of a low-frequency modulation signal M2 for driving a driver circuit for the light-emitting diode with a frequency f(M2) ~200 Hz and a duty cycle D2=85% of the modulation signal M2 at a lower brightness setting of a phase dimmer.

FIG. 8 shows an exemplary embodiment of time profiles of operating parameters of a light-emitting diode which occur as a result of a low-frequency modulation signal M2 having a frequency f(M2)~200 Hz and a duty cycle D2=25% of the modulation signal M2 in the case of a lower brightness setting of a phase dimmer.

In FIG. 7 and FIG. 8, the LED voltage that arises in the corresponding exemplary embodiments is designated by the reference symbol 4. Furthermore, in said figures, the reference symbol 5 denotes the resulting LED current, while the reference symbol 6 denotes the LED power.

The modulator circuit can be embodied discretely in analog fashion as in the exemplary embodiment according to FIG. 1, or as analog/digital integration in a common integrated circuit together in a PWM controller as illustrated in the exemplary embodiments in FIG. 4 and FIG. 5.

Furthermore, embodiments are conceivable wherein the decoding circuit and the modulator circuit are implemented in a combined fashion in a control circuit for the light-emitting diodes such as the LED controller, for example.

In this case, a time-dependent control voltage Vpc(t) divided down to a sufficient extent by a discrete voltage divider or a temporally averaged control voltage $\overline{V}$pc where Vpcmax<20 V can be generated. These control voltages Vpc (t) or $\overline{V}$pc can undergo signal processing in said controller, such that the values of the control voltage recorded over a suitable time interval, in the modulator circuit, generate a duty cycle D2 of the modulation signal M2 that lies within the range D2(Vpcmin(t))=D2min and D2(Vpcmax(t))=D2max.

In an implementation for "power line communication" signals, a decoding of the brightness level signal DL superposed on the supply voltage can be effected in such a way that the corresponding brightness regulator settings are converted in accordance with a defined communication protocol into the duty cycle D2 of the modulation signal M2 between ON phases and OFF phases or between ON phases and REDUCED phases. The modulation signal M2 thus obtained then acts on the driver circuit for the light-emitting diodes in a manner completely analogous to the above-mentioned description.

In a further embodiment, the above-mentioned circuits and methods, with their advantageous properties, can be applied to the operation and brightness regulation of organic light-emitting diodes for general lighting purposes. In particular, organic light-emitting diodes can also be used in incandescent lamp replacement by means of OLED bulbs which utilize only organic light-emitting diodes as a light source or supplement light from semiconductor-based light-emitting diodes in a suitable manner.

A number of different embodiments of the present invention will be further described very generally below.

A first embodiment concerns a method for regulating the brightness of at least one light-emitting diode in the field of general lighting (more particularly for incandescent lamp replacement) by means of a supply voltage comprising a brightness level signal DL. The method comprises the following steps:

In one step, the brightness level signal DL contained in the supply voltage is decoded. In a further step, the decoded brightness level signal DL is converted into a modulation signal M2 with a duty cycle D2 corresponding to the brightness level signal DL. In yet another step, a driver circuit for the at least one light-emitting diode is driven by means of a superposition signal made from a modulation signal M1 having a higher frequency than the modulation signal M2 by means of the modulation signal M2.

A second embodiment concerns a method based on the first embodiment, wherein the supply voltage is a phase-gated or phase-chopped supply voltage Vin(t).

A third embodiment concerns a method based on the first embodiment, wherein the supply voltage comprises a superposed brightness level signal DL, in particular, a "power line communication" signal.

A fourth embodiment concerns a method based on any of the above-mentioned embodiments, wherein the modulation signal M2 is suitable for fully switching off the driver circuit for the at least one light-emitting diode.

A fifth embodiment concerns a method based on any of the above-mentioned embodiments, wherein the modulation signal M2 comprises ON phases and OFF phases by means of which the driver circuit for the at least one light-emitting diode is controlled into a fully switched-on (ON) and, respectively, into a fully switched-off operating state (OFF).

A sixth embodiment concerns a method based on any of the first to fourth embodiments, wherein the modulation signal M2 comprises ON phases and REDUCED phases, by means of which the driver circuit for the at least one light-emitting diode is controlled into a fully switched-on and, respectively, into a reduced switched-on operating state (REDUCED).

A seventh embodiment concerns a method based on any of the above-mentioned embodiments, wherein the type of modulation of the modulation signal M2 comprises pulse width modulation (PWM), pulse density modulation (PDM) and similar types of modulation.

An eighth embodiment concerns a method based on any of the fifth to seventh embodiments, wherein the time intervals of the OFF phases or REDUCED phases of the modulation signal M2 are chosen in such a way that the human eye does not perceive any flicker of the light emitted by the at least one light-emitting diode; in particular said time intervals are chosen to be less than or equal to 10 ms.

A ninth embodiment concerns a method based on any of the above-mentioned embodiments, wherein the modulation signal M1 is a high-frequency modulation signal for efficient energy transfer from the driver circuit to the at least one light-emitting diode, wherein the high-frequency modulation signal M1 has a duty cycle D1 that is regulated such that during the ON phases of the modulation signal M2, the at least one light-emitting diode is supplied with a current corresponding to an operating range with predetermined color constancy.

A tenth embodiment concerns a method based on the ninth and the fifth or sixth embodiment, wherein during the ON phase of the modulation signal M2, the continuing high-frequency modulation signal M1 of the driver circuit drives the at least one light-emitting diode in a manner substantially unchanged by comparison with the case of a light-emitting diode whose brightness is not regulated.

An eleventh embodiment concerns a method based on the ninth and sixth embodiments, wherein during the OFF phase of the modulation signal M2, the driver circuit, which is thereby deactivated as a result of the high-frequency modulation signal M1 consequently not continuing, does not drive the at least one light-emitting diode.

A twelfth embodiment concerns a method based on the ninth and fifth embodiments wherein, during the REDUCED phase of the modulation signal M2, the continuing high-frequency modulation signal M1 of the driver circuit drives the at least one light-emitting diode in such a way that the at least one light-emitting diode emits a luminous flux that is negligible by comparison with the luminous flux that arises during the ON phase of the modulation signal M2.

A thirteenth embodiment concerns a method based on the twelfth embodiment wherein, the high-frequency modulation signal M1 of the driver circuit is pulse-width-modulated with a duty cycle 0<D1<D1red, wherein D1red is chosen such that a control circuit for the at least one light-emitting diode is sufficiently supplied with current.

A fourteenth embodiment concerns a method based on the ninth to twelfth embodiments, wherein the high-frequency modulation signal M1 of the driver circuit is pulse-width-modulated with a duty cycle 0<D1<1.

A fifteenth embodiment concerns a method based on the thirteenth to fourteenth embodiments, wherein the duty cycle D1 is increased at the beginning of the ON phase of the modulation signal M2 proceeding from a first value continuously over a plurality of period durations of the high-frequency modulation signal M1 to a second value and is reduced before the end of the ON phase of the modulation signal M2 continuously over a plurality of period durations of the high-frequency modulation signal M1 to the first value in order to avoid acoustic emissions of the driver circuit.

A sixteenth embodiment concerns a method based on the first to sixth or eighth to fifteenth embodiments, wherein the modulation signal M2 is pulse-width-modulated with a duty cycle D2min<D2≤1 wherein the duty cycle D2min corresponds to a minimum brightness level signal DL.

A seventeenth embodiment concerns a method for color-constant brightness regulation for at least one light-emitting diode. In one step, a brightness level signal DL contained in a supply voltage is converted into a modulation signal M2, by means of which a driver circuit for the at least one light-emitting diode is changed over between at least two predetermined operating states repeatedly with a duty cycle D2 corresponding to the brightness level signal DL in such a way that the at least one light-emitting diode is operated in an operating range with predetermined color constancy in at least one of the predetermined operation states of the driver circuit.

An eighteenth embodiment concerns a circuit for brightness regulation for at least one organic and/or one semiconductor-based light-emitting diode by means of a supply voltage comprising a brightness level signal DL. The eighteenth embodiment comprises a decoding circuit for decoding the brightness level signal DL contained in the supply voltage. Furthermore, this embodiment comprises a modulator circuit for converting the decoded brightness level signal DL into a modulation signal M2 for repeatedly (with a duty cycle D2 corresponding to the brightness level signal DL) changing over a driver circuit for the at least one light-emitting diode between at least two predetermined operating states. In this case, the modulation signal M2 can be superposed on a modulation signal M1 having a higher frequency. Furthermore, the at least one light-emitting diode can be operated in an operating range with predetermined color constancy by means of the modulation signal M1 in at least one of the two predetermined operating states of the driver circuit.

A nineteenth embodiment concerns a circuit based on the eighteenth embodiment, wherein the supply voltage is a phase-gated or phase-chopped supply voltage Vin(DL,t).

A twentieth embodiment concerns a circuit based on the nineteenth embodiment, wherein the decoding circuit is suitable for generating from the supply voltage Vin(DL,t), a control voltage Vpcin(DL,t), and/or a divided-down control voltage Vpc(DL,t), proportional thereto.

A twenty-first embodiment concerns a circuit based on the twentieth embodiment, wherein the modulator circuit for generating the modulation signal M2 can be driven directly by the divided-down control voltage Vpc(DL,t).

A twenty-second embodiment concerns a circuit based on the twentieth embodiment, wherein the decoding circuit is suitable for reducing the divided-down control voltage Vpc (DL,t), by a substantially constant voltage value Vconst.

A twenty-third embodiment concerns a circuit based on the twentieth or the twenty-second embodiment, wherein the decoding circuit is suitable for integrating the divided-down control voltage Vpc(DL,t) or the difference voltage between the divided-down control voltage and the constant voltage value Vpc(DL, t)−Vconst with an integration time constant $\tau$ and for driving the modulator circuit for generating the modulation signal M2 by means of the resulting integrated control voltage.

A twenty-fourth embodiment concerns a circuit based on the twenty-third embodiment, wherein the integration time constant $\tau$ is chosen to be greater than a half-period of the supply voltage, in particular according to $\tau$>10 ms, such that a temporally constant integrated control voltage $\overline{V}$pc(DL) arises.

A twenty-fifth embodiment concerns a circuit based on the twenty-third embodiment, wherein the integration time constant $\tau$ is chosen to be less than a half-period of the supply voltage, in particular according to 0<$\tau$≤10 ms, such that a temporally variable integrated control voltage $\overline{V}$pc(DL, t) arises which, by means of the resulting variation of the duty cycle D2 of the modulation signal M2, is suitable for increasing the power factor PF of the resulting current consumed by the driver circuit in the case of a predetermined input capacitance of the circuit, in particular to a power factor PF>0.7.

A twenty-sixth embodiment concerns a circuit for color-constant brightness regulation for at least one light-emitting diode. This embodiment comprises means for converting a brightness level signal DL contained in a supply voltage into a modulation signal M2, by means of which a driver circuit for the at least one light-emitting diode can be changed over between at least two predetermined operating states repeatedly with a duty cycle D2 corresponding to the brightness level signal DL in such a way that the at least one light-emitting diode can be operated in an operating range with predetermined color constancy in at least one of the predetermined operation states of the driver circuit.

A twenty-seventh embodiment concerns a brightness-regulable driver circuit for at least one light-emitting diode comprising a circuit based on any of the eighteenth to twenty-sixth embodiments.

A twenty-eighth embodiment concerns a brightness-regulable, non-isolated driver circuit for at least one light-emitting diode based on the twenty-seventh embodiment in a buck converter topology for converting an AC voltage as the supply voltage into a modulated constant current for the at least one light-emitting diode.

A twenty-ninth embodiment concerns a brightness-regulable, isolated driver circuit for at least one light-emitting diode based on the twenty-seventh embodiment, wherein a flyback converter topology for converting an AC voltage as the supply voltage into a modulated constant current for the at least one light-emitting diode.

A thirtieth embodiment concerns a brightness-regulable, isolated driver circuit for at least one light-emitting diode based on the twenty-ninth embodiment, wherein operating parameters for the at least one light-emitting diode are detectable and regulable on the secondary side of the flyback converter topology.

A thirty-first embodiment concerns a brightness-regulable, isolated driver circuit for at least one light-emitting diode based on the twenty-ninth embodiment, wherein operating parameters for the at least one light-emitting diode are derivable and regulable on the primary side of the flyback converter topology.

A thirty-second embodiment concerns the use of a circuit based on the eighteenth to thirty-first embodiments, in a light-emitting diode bulb (LED bulb) as incandescent lamp replacement for regulating the brightness of the light-emitting diode bulb by means of a phase-gated or phase-chopped dimmer circuit.

Although specific embodiments have been illustrated and described above, a person skilled in the art will recognize that the specific embodiments illustrated and described herein can be replaced by a multiplicity of alternative and/or equivalent implementations without these departing from the scope of protection of the present invention. The present application therefore covers all adaptations and/or modifications of the specific embodiments described herein. Therefore, the invention is only restricted by the subjects of the claims and the equivalents thereof.

What is claimed is:

1. A method for regulating a brightness of at least one light-emitting diode, the method comprising:

decoding a brightness level signal contained in a supply voltage;

converting the decoded brightness level signal into a first modulation signal with a duty cycle corresponding to the brightness level signal;

gating a second modulation signal with the first modulation signal to produce a superposition signal, wherein the second modulation signal has a higher frequency than the first modulation signal; and driving a driver circuit for the at least one light-emitting diode by the superposition signal, wherein the first modulation signal comprises ON phases and REDUCED phases, wherein the driver circuit is controlled into a fully switched-on state during the ON phases and into a reduced switched-on operating state during the REDUCED phases.

2. The method as claimed in claim 1, wherein the supply voltage comprises a phase-gated supply voltage.

3. The method as claimed in claim 1, wherein the supply voltage comprises a phase-chopped supply voltage.

4. The method as claimed in claim 1, wherein the first modulation signal comprises ON phases and OFF phases, wherein the driver circuit is controlled into a fully switched-on state during the ON phases and into a fully switched-off operating state during the OFF phases.

5. The method as claimed in claim 4, wherein time intervals of the OFF phases of the first modulation signal are chosen in such a way that a human eye does not perceive any flicker of light emitted by the at least one light-emitting diode.

6. The method as claimed in claim 4, wherein time intervals of the OFF phases of the first modulation signal are less than or equal to 10 ms.

7. The method as claimed in claim 1, wherein time intervals of the REDUCED phases of the first modulation signal are chosen in such a way that a human eye does not perceive any flicker of light emitted by the at least one light-emitting diode.

8. The method as claimed in claim 1 wherein time intervals of the REDUCED phases of the first modulation signal are less than or equal to 10 ms.

9. The method as claimed in claim 1, wherein the second modulation signal is a high-frequency modulation signal for efficient energy transfer from the driver circuit to the at least one light-emitting diode.

10. The method as claimed in claim 9, wherein the second modulation signal has a duty cycle that is regulated such that, during ON phases of the first modulation signal, the at least one light-emitting diode is supplied with a current corresponding to an operating range with predetermined color constancy.

11. The method as claimed in claim 1, wherein driving the driver circuit causes the at least one light-emitting diode to emit light for a general lighting application.

12. A method for color-constant brightness regulation for at least one light-emitting diode, the method comprising:

converting a brightness level signal contained in a supply voltage into a modulation signal, and operating a driver circuit for the at least one light-emitting diode in at least two predetermined operating states repeatedly with a duty cycle corresponding to the brightness level signal in such a way that the at least one light-emitting diode is operated in an operating range with predetermined color constancy in at least one predetermined operation state of the driver circuit, wherein a first of the at least two predetermined operating states is an ON state in which the driver circuit is fully switched on, and a second of the at least two predetermined operating states is a REDUCED state in which the driver is in a reduced switched-on operating state.

13. A circuit comprising:

a decoding circuit configured to decode a brightness level signal contained in a supply voltage; and a modulator circuit configured to convert the decoded brightness level signal into a first modulation signal that has a duty cycle corresponding to the brightness level signal, the first modulation signal for repeatedly changing over a driver circuit for at least one light-emitting diode between at least two predetermined operating states, wherein the first modulation signal is superposed on a second modulation signal having a higher frequency to produce a superposition signal, and wherein the superposition signal drives the driver circuit, wherein a first of the at least two predetermined operating states is an ON state in which the driver circuit is fully switched on, and a second of the at least two predetermined operating states is a REDUCED state in which the driver is in a reduced switched-on operating state.

14. The circuit according to claim 13, wherein the at least one light-emitting diode can be operated in an operating range with pre-determined color constancy using the first modulation signal in at least one of the two predetermined operating states of the driver circuit.

15. The circuit according to claim 14, further comprising the driver circuit.

16. The circuit according to claim 15, further comprising the at least one light-emitting diode.

17. The circuit according to claim 16, wherein the at least one light-emitting diode comprises a semiconductor light emitting diode.

18. The circuit according to claim 17, wherein the at least one light-emitting diode comprises an organic light emitting diode.

19. A circuit for color-constant brightness regulation for at least one light-emitting diode, the circuit comprising:

means for decoding a brightness level signal contained in a supply voltage; and means for converting the decoded brightness level signal into a first modulation signal that has a duty cycle corresponding to the brightness level signal, the first modulation signal for repeatedly changing over a driver circuit for at least one light-emitting diode between at least two predetermined operating states, wherein the first modulation signal is superposed on a second modulation signal having a higher frequency, wherein the first modulation signal gates the second modulation signal to produce a superposition signal, and wherein the superposition signal drives the driver circuit, wherein a first of the at least two predetermined operating states is an ON state in which the driver circuit is fully switched on, and a second of the at least two predetermined operating states is a REDUCED state in which the driver is in a reduced switched-on operating state.

* * * * *